United States Patent [19]

Ayd

[11] Patent Number: 5,069,565

[45] Date of Patent: Dec. 3, 1991

[54] COMPUTER PRINTER FOR PRINTING LABELS AND TAGS HAVING VERTICALLY ORIENTATED TRACTOR FEED

[76] Inventor: Jeffrey Ayd, 4 Village Cir., Westfield, N.J. 07090

[21] Appl. No.: 287,597

[22] Filed: Dec. 19, 1988

Related U.S. Application Data

[63] Continuation of Ser. No. 877,842, Jun. 24, 1986, abandoned.

[51] Int. Cl.[5] ..... B41J 11/30

[52] U.S. Cl. ..... 400/616; 400/616.2

[58] Field of Search ..... 400/616–616.2, 400/616.3

[56] References Cited

U.S. PATENT DOCUMENTS

| | | | |
|---|---|---|---|
| 3,430,748 | 3/1969 | Parri | 400/625 |
| 3,587,812 | 6/1971 | Budenstein | 400/616.1 |
| 3,644,812 | 2/1972 | Bitto et al. | 400/616.1 |
| 3,744,820 | 7/1973 | Porter | 400/616.1 |
| 3,869,980 | 2/1975 | Schroeder | 400/582 |
| 3,899,971 | 8/1975 | Dudley | 101/292 |
| 3,908,544 | 9/1975 | Seidl et al. | 101/292 |
| 4,058,196 | 11/1977 | Rempel | 400/616.1 |
| 4,164,376 | 8/1979 | Yarp | 400/616.1 |
| 4,344,715 | 8/1982 | Van Horne et al. | 400/616.1 |
| 4,386,860 | 6/1983 | Price et al. | 400/124 |
| 4,400,105 | 8/1983 | Yeager et al. | 400/616 |
| 4,440,516 | 4/1984 | Rosenthal et al. | 400/616.1 |
| 4,475,833 | 10/1984 | Sawicki | 400/605 |
| 4,519,723 | 5/1985 | Kusmierz | 400/616.2 |
| 4,564,411 | 1/1986 | Holzer | 400/615.1 |
| 4,565,462 | 1/1986 | Yamamoto et al. | 400/625 |
| 4,743,130 | 5/1988 | Katgiri et al. | 400/616.1 |
| 4,761,087 | 8/1988 | Ward et al. | 400/616.1 |

FOREIGN PATENT DOCUMENTS

| | | | |
|---|---|---|---|
| 3421535 | 12/1984 | Fed. Rep. of Germany | 400/616 |

*Primary Examiner*—Edgar S. Burr
*Assistant Examiner*—John S. Hilten
*Attorney, Agent, or Firm*—Hedman, Gibson, Costigan & Hoare

[57] ABSTRACT

A portable personal computer printer adapted for printing heavy print media such as tags and label stock by drawing the media vertically through the printer without substantial bending of the media.

14 Claims, 3 Drawing Sheets

COMPUTER PRINTER FOR PRINTING LABELS AND TAGS HAVING VERTICALLY ORIENTATED TRACTOR FEED

This application is a continuation of U.S. application Ser. No. 877,842 filed 24 June 1986, now abandoned.

BACKGROUND OF THE INVENTION

This invention is directed to a convenient, and relatively inexpensive computer printer adapted for use in printing labels and tag media.

The purchase and use of computers in the retail sales industry is growing geometrically. The growth has been aided by the realization of the time saving and convenience offered by the relatively inexpensive personal computers, particularly in the areas of bookkeeping and inventory control.

The small computer printer, however, has not kept abreast with the software available for complete and effective inventory control and identification.

Specifically, the portable personal printer has not, heretofore, been effective for printing price tags and labels which tend to delaminate during printing. The reason for this is that portable personal computer printers are designed to accomodate light weight single and multiple part media and not heavier print media such as label or tag stock. To effectively control the feed of the light weight stock, friction feed components are incorporated into the printer similar to those found in conventional typewriters. The friction feed components, however, restrict the smooth and continuous feed of heavier stock. Since the print media must be bent around the friction components and over a platen out toward the rear of the printer, the heavier media created excessive resistance which caused the printer to occasionally lose line registration. Also, the excessive bending of label stock around the friction components would occasionally cause labels to delaminate or peel off the support as they passed around the platen.

Consequently, portable personal computer printers are generally not used to print labels and tags in the retail sales industry and the retailer is faced with using the larger, more expensive tag printing machines to perform their tagging operation In sum, there is a need for a simple, convenient and portable personal computer printer capable of handling label and tag stock.

SUMMARY OF THE INVENTION

In accordance with the present invention, there is provided a new and unique data tagging printer which offers the advantages of portability, simplicity and convenience. The data tagging printer is particularly suited for use with a portable microcomputer so as to maintain the accessibility of the printer while increasing the number of applications it can be utilized for.

The data tagging printer of the present invention includes many of the components found in conventional personal printers, i.e., a base, an upper cover, a print head, a platen, against which print media rests, a tractor assembly for continuously pulling the print media through the printer and a print head for printing on the media. The present invention, however, eliminates a number of the conventional components while modifying others so as to be capable of accomodating the heavier print media simply and without loss of line registration.

Specifically, the friction components commonly referred to as a paper chute assembly, paper guide assembly, indicator assembly and (paper) end lines are absent from the present invention. These components, while necessary for properly feeding and guiding light weight print media, e.g., single sheet and multiple part forms, through the printer, pose serious problems in the effective feeding and printing of heavier print media.

In addition, the removal of the frictional components allows the heavier print media to be drawn linearly through the printer thereby avoiding the bending of the print media.

The printer, according to the present invention, includes a slot in the base for feeding the print media in a substantially vertical direction through the printer between the platen and the print head to engage the tractor assembly. The printer, though capable of handling any conventional computer print media is particularly well suited for conventional tag or label stock having rows of spaced holes along its margins. The tractor assembly is mounted to the printer above the platen in such a position so as to be capable of drawing the print media through the printer in a substantially uniplanar path. The tractor assembly has toothed sprocket wheels at either end that engage the spaced holes in the print media so that when the sprocket wheels are incrementally rotated by the printer motor the print media is indexed across the platen.

In essence, the printer of the present invention allows the heavier print media to be fed through the printer through a course having no bends and fewer engaging components, thereby minimizing frictional resistance and improving the print quality.

BRIEF DESCRIPTION OF THE DRAWINGS AND DETAILED DESCRIPTION OF THE INVENTION

The following is a detailed description together with the accompanying drawings of an illustrative embodiment of the invention. It is to be understood that the invention is capable of modification and variation apparent to those skilled in the art within the spirit and scope of the invention.

Figure 2:
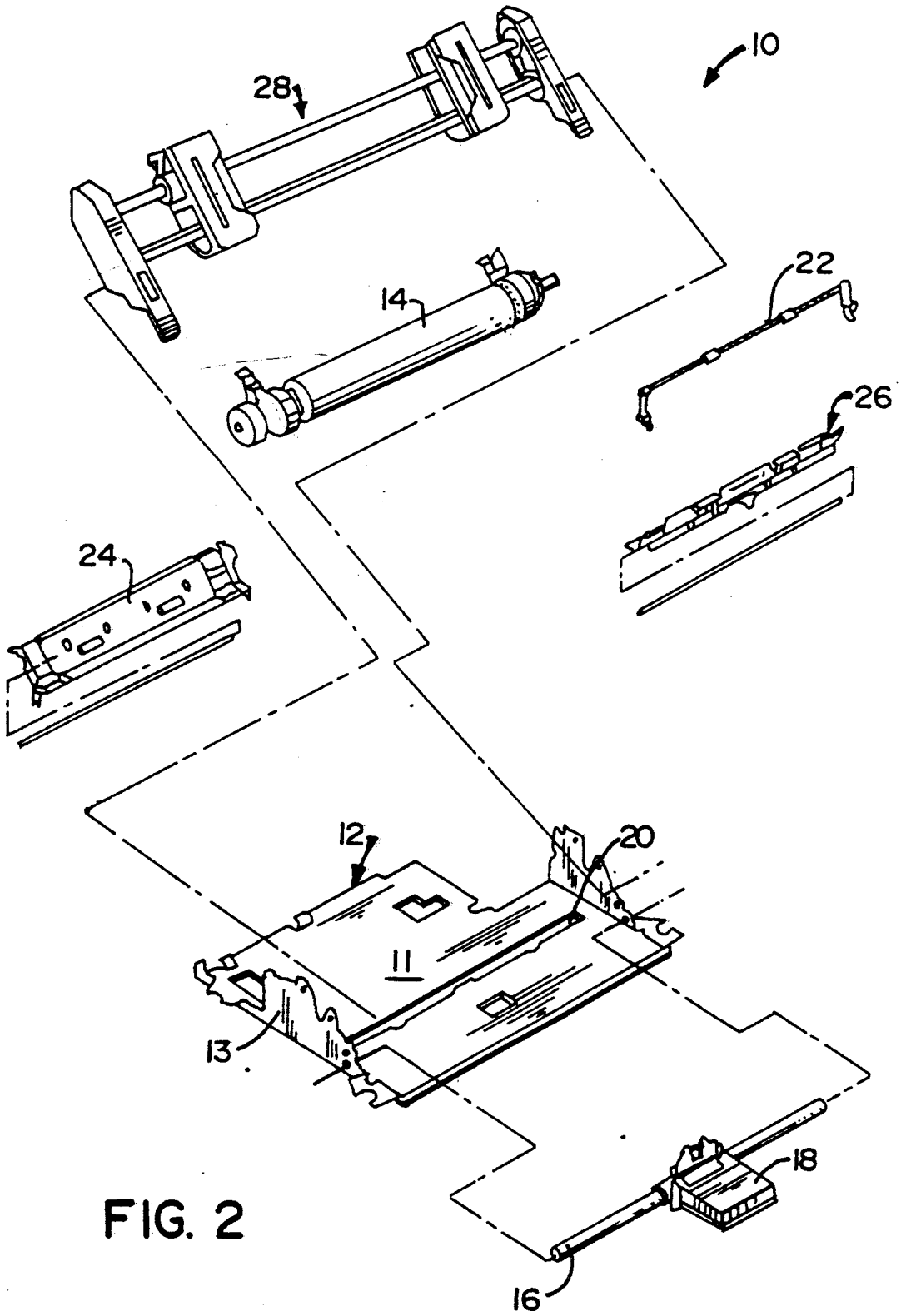
FIG. 2 is an exploded, schematic view depicting the major components of a conventional computer printer.

The improvements of the subject invention are embodied in the environment of a conventional computer printer which is illustrated schematically in FIG. 2.

Referring to FIG. 2, there is shown an exploded view of a computer printer 10, identifying the major components found in a conventional computer printer.

As seen, the computer printer 10 comprises a frame 12 having a base 11 and opposing sides 13 for supporting a platen 14 and a printer carriage 16 with a printhead 18 slidably mounted thereto. A paper feed slot 20, is provided in the base 11 of the frame 12 through which print paper (not shown) is fed.

The print paper is fed across the platen 14 between the platen 14 and an indicator assembly 22 which exerts pressure on the paper against the platen 14. A paper chute assembly 24 and paper guide assembly 26 are provided for guiding the print paper through the printer 10.

A tractor assembly 28 is attached to the frame 12 for drawing the print paper through the slot 20 between the platen 14 and indicator assembly 22 and across the paper chute assembly 24 and guide assembly 26.

Figure 6:
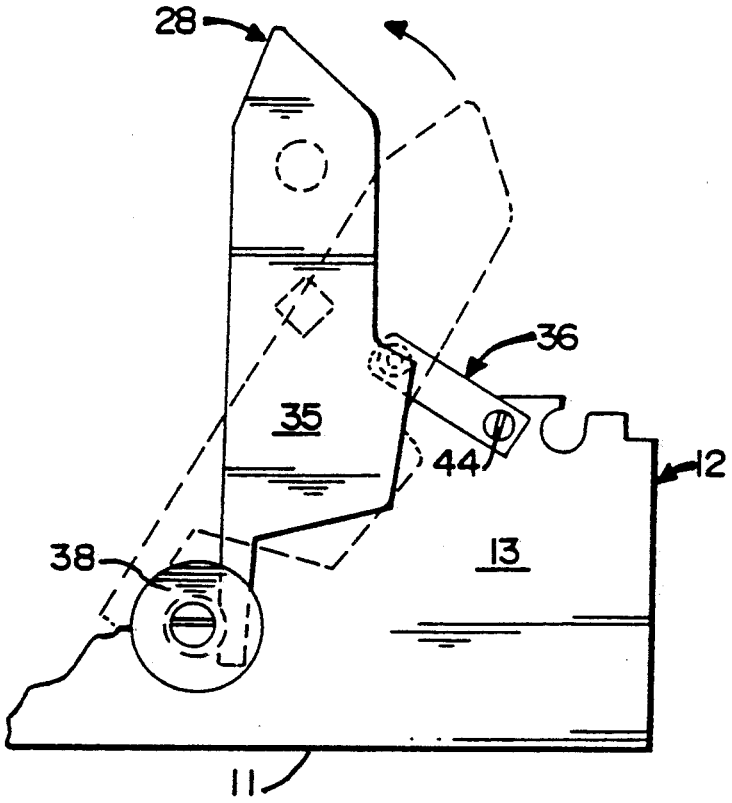
FIG. 6 is a view through section 6—6 of FIG. 1 illustrating the tractor secured in a vertical position by a bracket and fastening means in accordance with the present invention.

As shown, the tractor assembly is mounted at a substantial incline relative to the base 11 of the frame 12 (illustrated by the broken line in FIG. 6).

Figure 1:
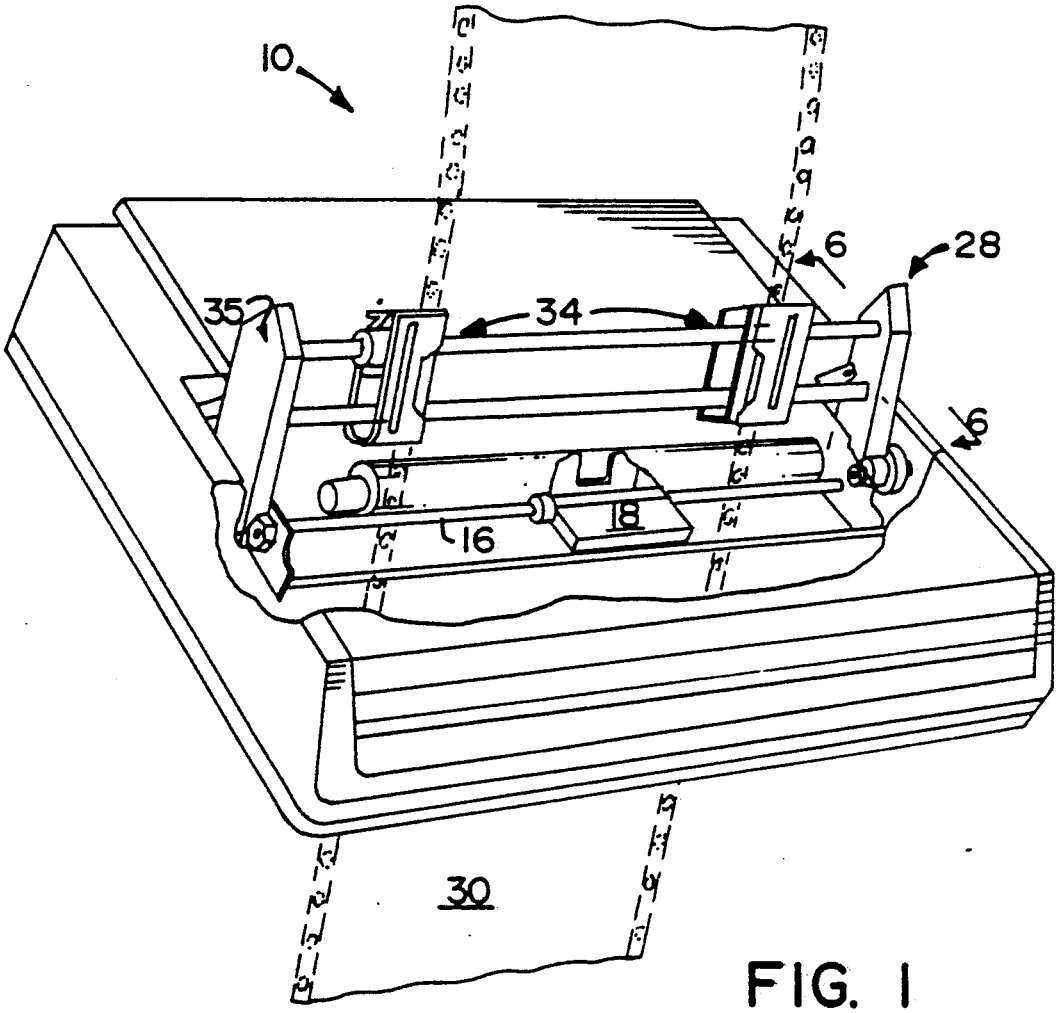
FIG. 1 is a perspective view of a computer printer showing print media being drawn vertically across the platen by a pair of tractors in accordance with the present invention.

It is an object of the present invention to minimize the frictional resistance exerted on the print paper fed through a conventional computer printer as illustrated in FIG. 1 so as to be capable of feeding heavy print media, e.g., tag or label stock through the printer 10. This is accomplished first, by the removal of several of the frictional components of the printer and second, by providing a means for directly feeding the print media through the printer 10 in a substantially uniplanar path.

Specifically, the frictional feed components comprising the paper chute assembly 24, the paper guide assembly 26 and indicator assembly 22 illustrated in the conventional computer printer 10 in FIG. 2, are necessarily removed from the computer printer of the present invention. These elements are not only superfluous in the application of the computer printer to heavy print media but further impede the smooth and continuous feeding of the heavy print media by providing unnecessary frictional resistance to the feeding operation.

The computer printer 10 of the present invention is further modified by remounting the tractor assembly 28 so that the print media can be directly drawn through the printer 10 in a direction substantially perpendicular to the base 11 of the frame 12 and thereby virtually eliminating bending of the print media as it is drawn through the printer 10.

Referring to FIG. 1, there is shown the preferred embodiment of the computer printer 10 loaded with heavy print media 30. For convenience, we have assigned the same numbers from the conventional printer of FIG. 2 to the comparable structural parts of the computer printer of the present invention.

The heavy print media 30 is fed through a slot 20 (not shown) in the base 11 of the frame 12 and passes between a printer carriage 16 and a platen 14. The platen 14 is mounted to the sides 13 of the frame 12 adjacent to the slot 20. A printhead 18 is slidably mounted on the printer carriage 16 for printing on the heavy print media 30.

The heavy print media 30 has spaced holes 32 along its vertical margins and is continuously drawn across the platen 14 by a tractor assembly 28 having a pair of tractors 34 driven by a conventional printer motor (not shown). The tractor assembly 28 includes mounting ends 35 for securing the tractor assembly 28 to the sides 13 of the frame 12. The tractor assembly 28 may be conventional, so long as it is adaptable to the sides of the frame 12 of the printer 10 so that media engaging tractors 34 are in a substantially vertical position.

Each of the tractors 34 have a toothed sprocket wheel (not shown) which engages the spaced holes 32 of the media 30 so as to move the heavy print media 30 across the platen 14 as the tractors 34 are indexed. As seen, the paper indicator assembly 22 shown in FIG. 2 to frictionally engage the print media to the platen 14, is absent from the present invention illustrated in FIG. 1. The paper chute assembly 24 and paper guide assembly 26 are also absent from the embodiment of FIG. 1.

As shown in FIG. 6, the tractor assembly 28 in the preferred embodiment of the present invention (shown as solid lines) is positioned vertically with respect to the base 11 of the frame 12. The mounting ends 35 of the tractor assembly 28 are secured in the vertical position by means of a pair of mounting brackets 36 and a pair of retainer assemblies 38.

Figure 5:
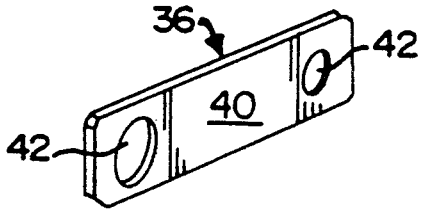
FIG. 5 is a perspective view of the tractor mounting bracket in accordance with the present invention.

The mounting brackets 36, shown in detail in FIG. 5, are comprised of substantially rectangular stock 40 having bores 42 at either end for receiving conventional fastening means e.g., screw or bolt and locknut combinations for attaching the mounting ends 35 to the sides 13 of the printer frame 12.

As shown in FIG. 6, the mounting bracket 36 is fastened to the frame 12 by means of a screw 44 passing through one of said bores 42 and into the side 13 of said frame 12. Similarly, a second screw 44 passes through the second of said bores 42 and into the mounting end 35 of said tractor assembly 28. As seen, the mounting bracket 36 is of sufficient length so as to secure the tractor assembly 28 in a substantially vertical position relative to the frame 12. It is understood that the length of the mounting bracket 36 may vary depending on the type of computer printer and tractor assembly selected for incorporating the improvements of the present invention.

Figure 3:
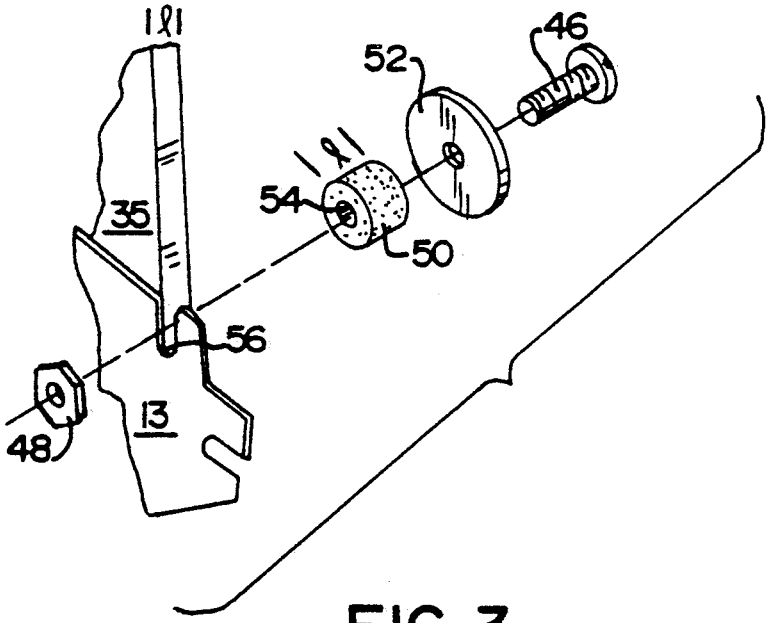
FIG. 3 is an exploded perspective view of the tractor fastening means in accordance with the present invention.

The retainer assemblies 38 are shown in detail in the exploded view of FIG. 3. The retainer assemblies 38 serve to secure the mounting ends 35 in the vertical position. Without the retainer assemblies 38, the tractor assembly 28 would be susceptible to pivoting about the mounting brackets 36 as a result of vibrations attendant the printing operation.

As shown in FIG. 3, the retainer assembly 38 comprises a bolt 46 and lock nut 48 combination having a spacer bushing 50 and washer 52 therebetween. The spacer bushing 50 includes a center bore 54 therethrough and is of a length "l" equal to the thickness of the mounting end 35 of the tractor assembly 28.

Figure 4:
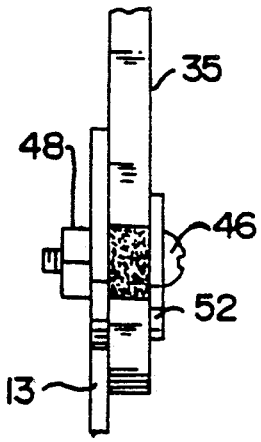
FIG. 4 shows the right side of the tractor assembly fastened to the printer in accordance with the present invention.

When assembled, the bolt 46 passes through the washer 52 and the center bore 54 of the bushing 50 and through an opening 56 in the side 13 of the frame 12. The locknut 48 is attached to the screw 46 and tightened for urging the washer 52 against the mounting end 35. The bolt 46 and locknut 48 are tightened to a sufficient force to prevent the tractor assembly 28 from shifting from its vertical position. The retainer assembly 38 and mounting end 35 are shown completely assembled and tightened in FIG. 4. As illustrated, the end 35 is secured between the washer 52 and side 13 of the frame 12 by the action of the bolt 46 and locknut 48 assembly.

While one type of computer printer is shown in the illustrative embodiment, it is to be understood that the present invention can be applied to a wide variety of personal computer printers which provide a bottom paper feed.

Furthermore, the invention in its broader aspects is not limited to the specific described embodiment and departures may be made therefrom within the scope of the accompanying claims without departing from the principles of the invention and without sacrificing its chief advantages.

It is claimed:

1. A computer printout adapted for feeding heavy print media, comprising:

a frame having a base, opposing sides and a feed slot in said base;

a platen positioned within said frame adjacent to and above said feed slot;

means connected to said frame above and adjacent said platen for vertically drawing the print media across the platen free of frictional engaging means, wherein said means for vertically drawing the print media through the printer comprises a tractor assembly having ends for mounting said tractor assembly to said opposing sides of said frame and a pair of tractors, and wherein said tractor assembly is mounted to the sides of said frame in a position perpendicular to the case of said frame by a pair of mounting brackets and retainer assembly, each said retainer assembly comprising a bolt and locknut combination including a bushing and a retainer washer therebetween said bolt passes through an opening in the side of said frame adjacent said mounting bracket and is further tightened to engage said retainer washer against said mounting bracket thereby securing said mounting bracket to said frame.

2. A computer printer according to claim 1, wherein said heavy print media are labels.

3. A computer printer according to claim 1, wherein said heavy print media are price tags.

4. A computer printer according to claim 1 further comprising positioning means for positioning said drawing means in a plane vertical to said feed slot and said support means.

5. A computer printer according to claim 4, wherein said positioning means is associated with at least one of the pair of mounting brackets disposed between said frame and said drawing means and at least one of the pair of retainer assemblies having contact with both said frame and said drawing means so as to prevent shifting of said drawing means from a vertical position.

6. A computer printer according to claim 5, wherein said mounting bracket is comprised of substantially rectangular stock having bores at each end thereof for receiving fastening means for fastening said stock to said frame and said drawing means.

7. A computer printer according to claim 6, wherein said retainer assembly is comprised of spacing means attached to said frame, said spacing means equal to the thickness of the mounting brackets of said drawing means.

8. A portable computer printer for printing on heavy print media, comprising:

a frame comprised of a base and opposing sides and having a feed slot in the base of said frame;

a platen located within and connected to said frame for guiding said print media, said platen positioned above said feed slot; and drawing means for vertically drawing said print media through said printer, said drawing means connected to said frame above said platen, wherein said feed slot, said platen and said drawing means define a vertically planar and said drawings means define a vertically planar and substantially frictionless path for said print media, said print media being drawn through said printer without substantial bending, said means for vertically drawing the print media through the printer comprising a tractor assembly having ends for mounting said tractor assembly to opposing sides of said frame and a pair of tractors wherein said tractor assembly is mounted to the sides of said frame in a position substantially perpendicular to the base of said frame by a pair of mounting brackets and retainer assemblies, each said retainer assembly comprising a bolt and locknut combination including a bushing and a retainer washer therebetween wherein said bolt passes through an opening in the side of said frame adjacent said mounting bracket and is further tightened to engage said retainer washer against said mounting bracket thereby securing said mounting bracket to said frame.

9. A portable computer printer according to claim 8 which said heavy print media are labels.

10. A portable computer printer according to claim 8 wherein said heavy print media are tags.

11. A portable computer printer according to claim 8 further comprising positioning means for positioning said drawings means in a plane vertical to said feed slot and said support means.

12. A portable computer printer according to claim 8, wherein said positioning means is associated with at least one of the pair of mounting brackets disposed between said frame and said drawing means and at least one of the pair of retainer assemblies having contact with both said frame and said drawing means so as to prevent shifting of said drawing means from a vertical position.

13. A portable computer printer according to claim 8, wherein said mounting bracket is comprised of substantially rectangular stock having bores at each end thereof for receiving fastening means for fastening said stock to said frame and said drawing means.

14. A portable computer printer according to claim 8, wherein said retainer assembly is comprised of spacing means attached to said frame, said spacing means equal to the thickness of the mounting brackets of said drawing means.

* * * * *